United States Patent [19]

Kuhnsman

[11] Patent Number: 4,529,193

[45] Date of Patent: Jul. 16, 1985

[54] ILLUMINATABLE JUMP ROPE DEVICE

[76] Inventor: Alexandra Kuhnsman, R.D. 1, Box 206, Oxford, N.J. 07863

[21] Appl. No.: 563,597

[22] Filed: Dec. 20, 1983

[51] Int. Cl.[3] ..... A63B 5/20

[52] U.S. Cl. ..... 272/75; 446/485

[58] Field of Search ..... 272/74, 75; 273/DIG. 24; 446/219, 485; 358/901

[56] References Cited

U.S. PATENT DOCUMENTS

| | | | |
|---|---|---|---|
| 1,751,584 | 3/1930 | Hansell | 358/901 |
| 3,066,439 | 12/1962 | Lemelson | 446/485 |
| 3,391,935 | 7/1968 | Gross | 446/485 |
| 3,605,333 | 9/1971 | Copeland | 446/485 |
| 3,707,055 | 12/1972 | Pearce | 446/485 |
| 4,208,701 | 6/1980 | Schock | 446/485 |

FOREIGN PATENT DOCUMENTS

| | | | |
|---|---|---|---|
| 2276069 | 1/1976 | France | 272/75 |

OTHER PUBLICATIONS

Edmunds Scientific Co., Catalog 731, 1972, p. 158.

*Primary Examiner*—Richard J. Apley
*Assistant Examiner*—S. R. Crow
*Attorney, Agent, or Firm*—Kenneth P. Glynn

[57] ABSTRACT

The present invention is an illuminatable jump rope device. It includes a hollow, elongated tube which is nonopaque and which is of sufficient length, strength and flexibility to be used for jumping, and two handles, one each being connected to opposite ends of the tube. In addition, two sets of battery operated illumination circuitry of the flashlight type are included, and each being located within each of said two handles. There are two on-off switches, one each being connected to each of said two sets of circuitry, and two light bulbs, one each being connected to one of two sets of circuitry and being connectively positioned with respect to each of two said handles so as to be capable of shining away from each of the two handles and into the tube. Lastly, the device includes at least two bundles of optical fibers contained within the tube, at least one such bundle being positioned in the light path of each of the two bulbs so as to be capable of fiber optic illumination within the tube.

12 Claims, 3 Drawing Figures

ILLUMINATABLE JUMP ROPE DEVICE

BACKGROUND OF THE INVENTION

1. Field of the Invention

The present invention is directed to a novel "jump rope," and more particularly an illuminatable jump rope. The present invention device is specifically a plastic type of jump rope which utilizes fiber optics for illumination.

2. Prior Art Statement

The art is replete with novel jump ropes having whistles, noisemakers and other features which enhance the entertainment and enjoyment value for children and, in some cases, adults who are children at heart. Notwithstanding this formidable collection of general prior art relating to jump ropes, no patent has issued in the United States on the illumination of jump ropes. French Pat. No. 2,276,069 to Maurice Fradin teaches an illuminated jump rope but relies upon a plurality of strings of bulbs running through a tube and relies upon complex mechanical and electrical arrangements.

Specifically, French Pat. No. 2,276,069 describes a jump rope with handles which operate longitudinally at right angles to the length of the tube containing the strings of lights. This necessitates a "yoke" or "axle" arrangement for each handle whereby the yoke is connected to the tube and must rotate 360° around the handle for each jump. The present invention, on the other hand, eliminates the yoke and the rotation of the tube around the handles.

Further, French Pat. No. 2,276,069 also requires circuitry connected by sliding ring tracks which may eventually malfunction due to spring failure, mechanical wear or other failure. On the other hand, the present invention eliminates moving parts (except for the on-off switch.)

Additionally, French Pat. No. 2,276,069 teaches the use of many light bulbs in strings, which may blow out, short or wear out. The present invention device, on the other hand, requires only two bulbs, substantially decreasing the likelihood of failure, decreasing the power requirements (smaller batteries) and otherwise constitutes a more practical invention.

Lastly, French Pat. No. 2,276,069 teaches strings of lights running through a tube, rendering bulbs close to the point of impact on the floor during jumping, resulting in impractical and possible damaging physical abuse of the bulbs. The present invention entirely eliminates these problems in that no bulbs are located down the tube where impact occurs, and optical fibers utlized in the present invention can readily withstand the physical abuse inherent in rope jumping.

For all the foregoing reasons it is urged that the present invention is neither taught nor rendered obvious by French Pat. No. 2,276,069.

SUMMARY OF THE INVENTION

A novel, illuminatable jump rope device is described which includes two handles and a hollow tube connected thereto. Each of the handles contains battery operated flashlight type circuitry with an on-off switch, and a bulb is connected to each circuit. A bundle of optical fibers extends into the hollow tube away from each of the bulbs. When the handles contain batteries and are turned on, light shines away from each of the handles into the fiber bundles so as to illuminate the hollow tube from both ends, preferrably throughout entire length of the tube.

BRIEF DESCRIPTION OF THE DRAWINGS

Various other objects, features and attendant advantages of the present invention will be more fully appreciated as the same becomes better understood from the following detailed description in connection with the accompanying drawings, in which like reference characters designate like or corresponding parts through the several views and wherein.

DETAILED DESCRIPTION OF THE PRESENT INVENTION

Figure 1:
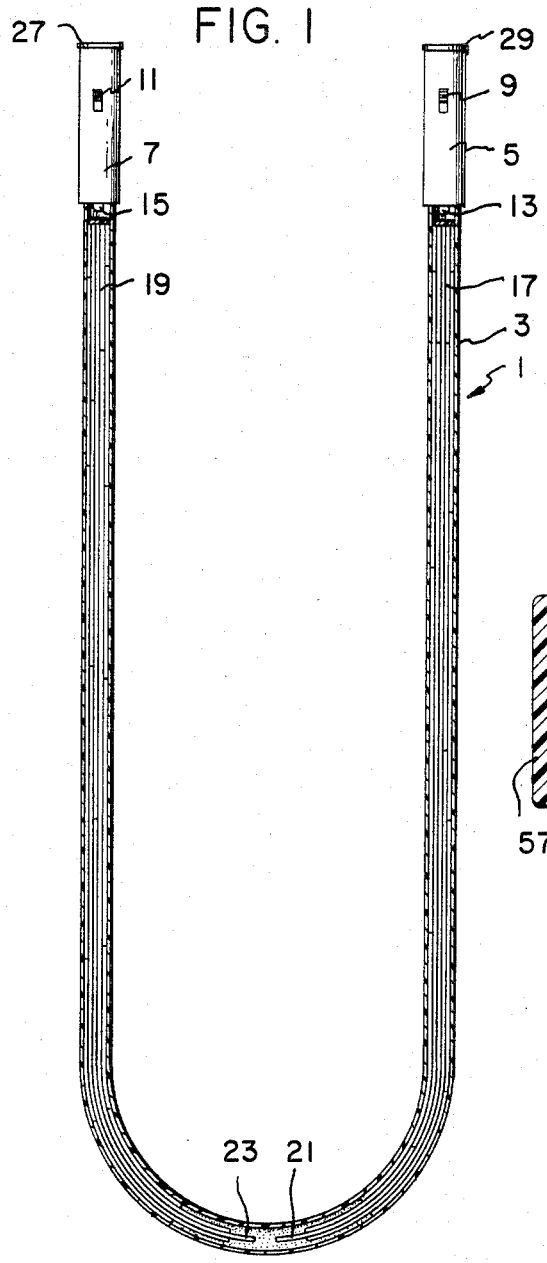
FIG. 1 is a frontal view of one preferred embodiment of the present invention device.

Referring now more particularly to the Figures, the present invention ILLUMINATABLE JUMP ROPE DEVICE 1 is shown in FIG. 1. A hollow elongated tube 3 is shown which is non-opaque. Tube 3 may be either translucent or transparent but is preferrably transparent, and is of sufficient length, strength, and flexability so as to be used for jumping. In this specific embodiment, tube 3 is made of clear Tygon tubing of about five-eighths to about three-quarters of an inch in diameter (Tygon tubing is a trade name product sold by Norton Specialty Plastic Division, Akron, Ohio).

Handles 5 and 7 are shown wherein they are connected to opposite ends of tube 3. Each of the handles 5 and 7 contain battery operated illumination circuitry of the flash light type which is shown in more detail in FIG. 3 below. On-off switches 9 and 11 are shown respectively on handles 5 and 7. Each of the on-off switches 9 and 11 are operatively connected to the mentioned circuitry contained within each of the handles, respectively. Light bulbs 13 and 15 are likewise respectively connected to the mentioned circuitry and are positioned so as to shine away from the handles and into hollow tube 3. While bulbs 13 and 15 are shown for illustrative purposes as extending beyond each of handles 5 and 7, they may be recesses within handles 5 and 7, and in one preferred embodiment are so recessed. Optional screw-off handle caps 25 and 27 facilitate insertion, removal and replacement of batteries.

In FIG. 1, two bundles of optical fibers 17 and 19 are contained within tube 3 and positioned within the light path of bulbs 13 and 15 respectively. Each bundle 17 and 19 contain optical fibers of varying length as shown, the longest of which are approximately one-half of the length of tube 3 and are shown as fibers 21 and 23. Also, as shown in FIG. 1, there is an unencumbered central zone between longest fibers 21 and 23 located at approximately one-half of the length of tube 3. This is, as can be seen, the area of greatest impact when device 1 is in use and separates the two fiber bundles 17 and 19. Each bundle 17 and 19 contains at least 60 optical fibers so as to create fiber optics illumination points throughout the entire tube 3. As a practical matter the bundle may be glued, force fitted, or otherwise held together by any conventional means in the area of bulbs 13 and 15 and may optionally include a directing lens such as is frequently used in flashlights, and may optionally include a color filter disc of one or more colors to create colored light points within hollow tube 3.

Figure 2:
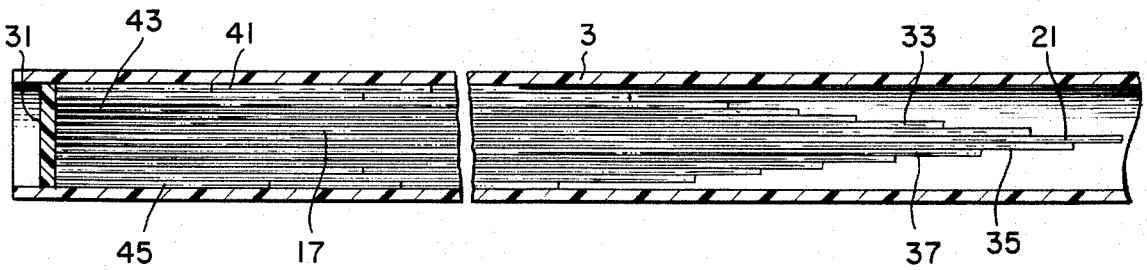
FIG. 2 shows a cut view of a section of hollow tube used in one embodiment of the present invention; and, FIG. 3 illustrates a side cut view of another embodiment of a handle for a device of the present invention.

FIG. 2 shows a cut view of a section of hollow tube 3 used in one embodiment of the present invention. As shown hollow tube 3 contains fiber bundle 17 and optional color disc 31. Longest fiber 21 is shown to be approximately coaxial with the central axis of tube 3 and longer fibers 33, 35, 37 and the like are bundled contiguously to longest fiber 21, whereas shorter fibers 41, 43, 45 and the like are bundled around and outside of the longer fibers.

Figure 3:
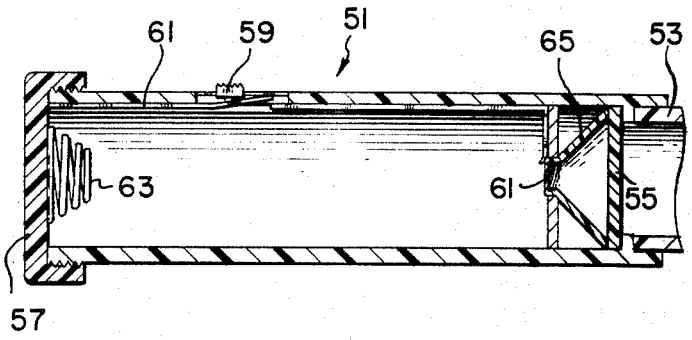

FIG. 3 shows a side cut view of a handle used in one preferred embodiment of the present invention. Handle 51 is shown with a section of hollow tube 53 bonded thereto. As shown, handle 51 is cyclindrical and it contains an optional bulb magnifying lens 55 at the end of the handle 51 which enters tube 53, and it contains an optional screw-off cap 57 at the opposite end. Handle 51 also contains on-off switch 59 and battery operated flashlight type circuitry 61. The circuitry includes coil spring terminal 63 and is connected to bulb holder 65. When a bulb is screwed into the socket 67 of holder 65 and batteries are inserted the circuit is opened and closed for operation via switch 59.

In general, all parts except for the conductive circuitry and glass lens are constructed of plastic, including the hollow tube. Further, while it is preferred to allow for battery replacement and even bulb replacement in actual design, one embodiment consists of permanently enclosing long life batteries and bulbs.

Obviously, numerous modifications and variations of the present invention are possible in light of the above teachings. It is therefore to be understood that within the scope of the appended claims, the invention may be practiced otherwise than as specifically described herein.

What is claimed is:

1. An illuminatable jump rope device which comprises:

(a) a hollow, elongated tube which is non-opaque and which is of sufficient length, strength and flexibility to be used for jumping;

(b) two handles, one each being connected to opposite ends of said tube;

(c) two sets of battery operated illumination circuitry of the flashlight type, one each being located within each of said two handles;

(d) two on-off switches, one each being connected to each of said two sets of circuitry;

(e) two light bulbs, one each being connected to one of two sets of circuitry and being connectively positioned within each of two said handles so as to be capable of shining away from each of two said handles and into said tube;

(f) at least two bundles of optical fibers contained within said tube, at least one such bundle being positioned in the light path of each of said two bulbs so as to be capable of fiber optic illumination within said tube, each bundle being of varied lengths of optical fibers, the longest of which is approximately one-half of the tube length, the total number of optical fibers within all of said bundles being at least sixty in number; and, (g) an unencumbered central zone within said tube located at approximately one-half the length of said tube and separating said fiber bundles at the area of greatest impact of the device in use.

2. The device of claim 1 wherein said tube is transparent.

3. The device of claim 1 wherein said tube is translucent.

4. The device of claim 1 wherein at least one color filter is positioned between a bulb and a fiber bundle so as to be capable of colored light fiber optics illumination.

5. The device of claim 2 wherein at least one color filter is positioned between a bulb and a fiber bundle so as to be capable of colored light fiber optics illumination.

6. The device of claim 3 wherein at least one color filter is positioned between a bulb and a fiber bundle so as to be capable of colored light fiber optics illumination.

7. The device of claim 1 wherein each of said two handles includes a spring loaded screw-off end to facilitate insertion and removal of batteries.

8. The device of claim 2 wherein each of said two handles includes a spring loaded screw-off end to facilitate insertion and removal of batteries.

9. The device of claim 3 wherein each of said two handles includes a spring loaded screw-off end to facilitate insertion and removal of batteries.

10. The device of claim 4 wherein each of said two handles includes a spring loaded screw-off end to facilitate insertion and removal of batteries.

11. The device of claim 5 wherein each of said two handles includes a spring loaded screw-off end to facilitate insertion and removal of batteries.

12. The device of claim 6 wherein each of said two handles includes a spring loaded screw-off end to facilitate insertion and removal of batteries.

* * * * *